US005557291A

United States Patent [19]

Chu et al.

[11] Patent Number: 5,557,291

[45] Date of Patent: Sep. 17, 1996

[54] MULTIBAND, PHASED-ARRAY ANTENNA WITH INTERLEAVED TAPERED-ELEMENT AND WAVEGUIDE RADIATORS

[75] Inventors: Ruey-Shi Chu, Cerritos; Kuan M. Lee, Brea; Allen T. S. Wang, Buena Park, all of Calif.

[73] Assignee: Hughes Aircraft Company, Los Angeles, Calif.

[21] Appl. No.: 451,084

[22] Filed: May 25, 1995

[51] Int. Cl.[6] ..... H01Q 21/00; H01Q 13/10; H01Q 13/00

[52] U.S. Cl. ..... 343/725; 343/770; 343/768; 343/776; 343/778

[58] Field of Search ..... 343/770, 771, 343/727, 725, 729, 767, 772, 776, 700 MS, 777, 778, 785, 768, 795; H01Q 21/00, 13/10, 13/00

[56] References Cited

U.S. PATENT DOCUMENTS

| | | | |
|---|---|---|---|
| 3,623,111 | 11/1971 | Boynes et al. | 343/727 |
| 4,573,056 | 2/1986 | Dudôme et al. | 343/795 |
| 4,623,894 | 11/1986 | Lee et al. | 343/700 |
| 4,905,013 | 2/1990 | Reindel | 343/795 |
| 5,087,922 | 2/1992 | Tang et al. | 343/818 |

OTHER PUBLICATIONS

Lee, J. J. and Livington, S. I., "Wideband Bunny-Ear Radiating Element", *IEEE AP-S International Symposium*, Ann Arbor, Michigan, 1993, pp. 1604–1607.

*Primary Examiner*—Hoanganh Le

*Attorney, Agent, or Firm*—Jeannette M. Walder; Wanda K. Denson-Low

[57] ABSTRACT

A multiband phased-array antenna interleaves tapered-element radiators with waveguide radiator to facilitate the simultaneous radiation of antenna beams across a bandwidth in excess of two octaves. The launch ends of the waveguide radiators collectively define a ground plane. The tapered-element radiators have pairs of tapered wings which are extended past the ground plane by a distance which is selected to establish a predetermined tapered wing radiation impedance. The radiators of each type are spaced apart by a span which insures that they will not generate grating lobes at the highest frequency which they respectively radiate.

12 Claims, 9 Drawing Sheets

MULTIBAND, PHASED-ARRAY ANTENNA WITH INTERLEAVED TAPERED-ELEMENT AND WAVEGUIDE RADIATORS

BACKGROUND OF THE INVENTION

1. Field of the Invention

The present invention relates generally to microwave phased-array antennas and more particularly to multiband phased-array antennas.

2. Description of the Related Art

Although the needs of many radar users can be satisfied with the generation of a single radar beam, other users require a plurality of radar beams which are each dedicated to a specific purpose. For example, major airports require radars that are directed to functions which can include medium-range air surveillance, long-range weather surveillance, airport surface detection, height-finding and traffic control. As a second example, naval shipboard environments require radars directed to functions that include long-range surveillance, navigation, weapons control, tracking and recognition and electronic warfare support measures (ESM).

Providing multiple antennas to handle such multiple tasks becomes especially difficult if the available antenna installation space is limited. This is particularly true in naval shipboard environments where the ship's superstructure is the preferred antenna location but there are numerous other demands for this space, e.g., bridge structures, ventilation and air conditioning structures and weapons mountings.

Because of its control of the phase of multiple radiating elements, a single phased-array antenna can simultaneously radiate and receive multiple radar beams. However, the unique requirements of the radar functions recited above typically dictate the simultaneous availability of radar beams which span multiple frequency bands. For example, long-range surveillance conventionally requires longer wavelengths, e.g., S band, precision-tracking and target-recognition radars generally operate most efficiently at shorter wavelengths, e.g., C band, and weapons control and doppler navigation are typically performed at still shorter wavelengths, e.g., X band and Ku band.

Because S band occupies the 2–4 GHz frequency region, C band occupies the 4–8 GHz frequency region and X band occupies the 8–12.5 GHz frequency region, radiation and reception of signals in all three bands requires a multiband, phased-array antenna with a bandwidth greater than two octaves. Such a single phased-array antenna with a bandwidth greater than two octaves could support multiple radar functions while being compatible with limited-space environments, e.g., shipboard.

A number of multiband radar antenna configurations have been proposed. For example, a structure of interlaced, contiguous waveguides was described in U.S. Pat. No. 3,623,111 which issued Nov. 23, 1971; an interleaved waveguide and dipole dual-band array antenna was described in U.S. Pat. No. 4,623,894 which issued Nov. 18, 1986 in the name of Kuan M. Lee, et al. and was assigned to Hughes Aircraft, the assignee of the present invention; and a coplanar dipole array antenna was disclosed in U.S. Pat. No. 5,087,922 which issued Feb. 11, 1992 in the name of Raymond Tang, et al. and was assigned to Hughes Aircraft, the assignee of the present invention.

Although these antenna configurations can radiate multiband antenna beams, the use of low frequency waveguides, e.g., S band (as proposed in U.S. Pat. No. 3,623,111), is preferably avoided because of their inherent bulk and the use of dipole antenna structures (as proposed in U.S. Pat. Nos. 4,623,894 and 5,087,922) is preferably avoided because of their inherent narrow-band performance.

SUMMARY OF THE INVENTION

The present invention is directed to a multiband, phased-array antenna which employs wide-band radiating elements to obtain an operational frequency range in excess of two octaves.

This goal is realized with an antenna aperture in which tapered-element radiators and waveguide radiators are arranged in an interleaved relationship. Each of the tapered-element radiators has a pair of tapered wings which enhance their wide-band radiation performance. The waveguide radiators are preferably arranged with their launch ends collectively defining a ground plane. The tapered wings of each tapered-element radiator are extended past this ground plane by a distance which is selected to establish a predetermined tapered wing radiation impedance.

The tapered-element radiators and the waveguide radiators are each spaced apart in the antenna aperture by a span which insures that they will not generate grating lobes at the highest frequency which they respectively radiate. The aperture is fed with a plurality of feed networks so that each radiated beam can be separately scanned with phase shifters and time delays that are imbedded in the feed networks.

In an embodiment, columns of tapered-element radiators are interleaved with columns of waveguide radiators. Every other column of tapered-element radiators is energized with its respective feed network. The other tapered-element radiator columns are inserted to enhance the grating lobe performance of the waveguide radiators. In other embodiments, the radiators are arranged to define rectangular and triangular lattices.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
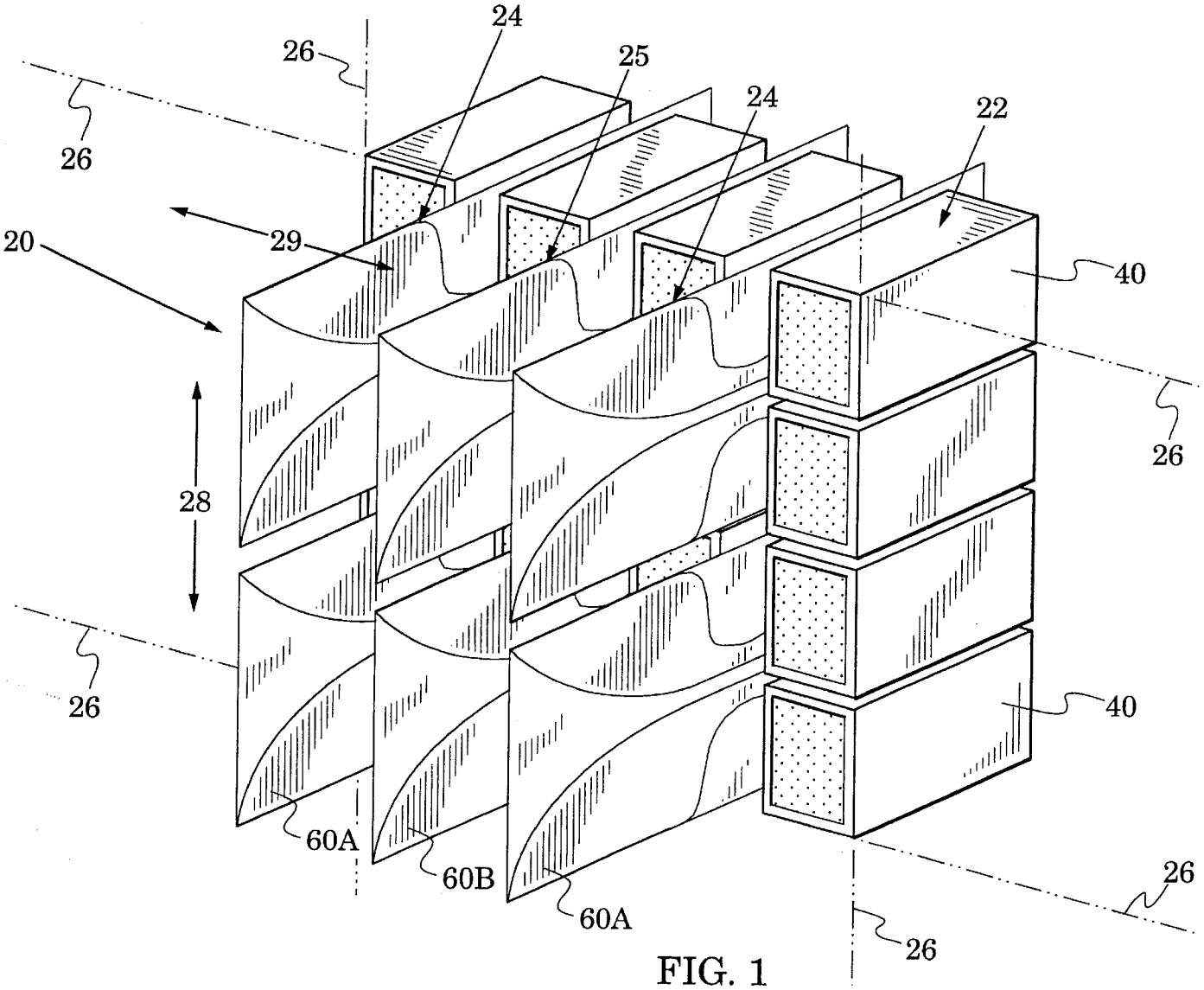
FIG. 1 is a perspective view of an aperture portion in a phased-array antenna in accordance with the present invention.
Figure 2:
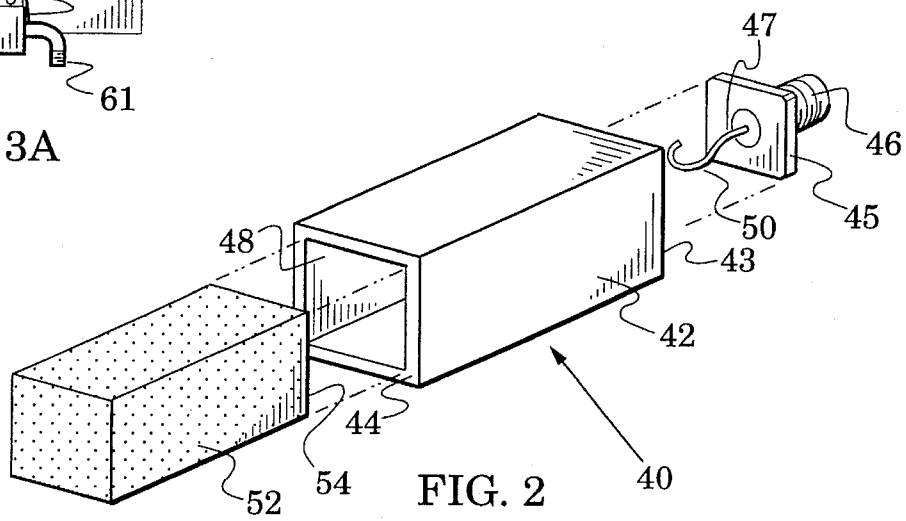
FIG. 2 is a perspective, exploded view of a waveguide radiator in the aperture portion of FIG. 1.
Figure 3A:
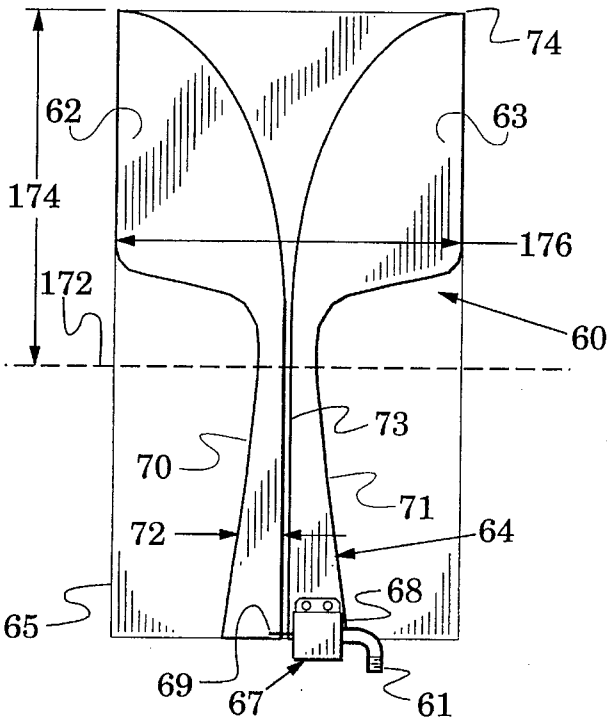
FIG. 3A is a plan view of a tapered-element radiator in the aperture portion of FIG. 1.
Figure 3B:
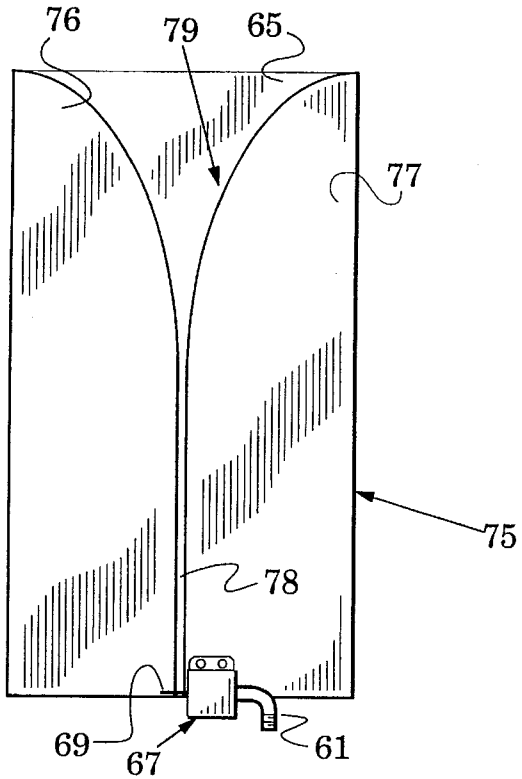
FIG. 3B is a plan view of another tapered-element radiator which is suitable for use in the aperture portion of FIG. 1.
Figure 4:
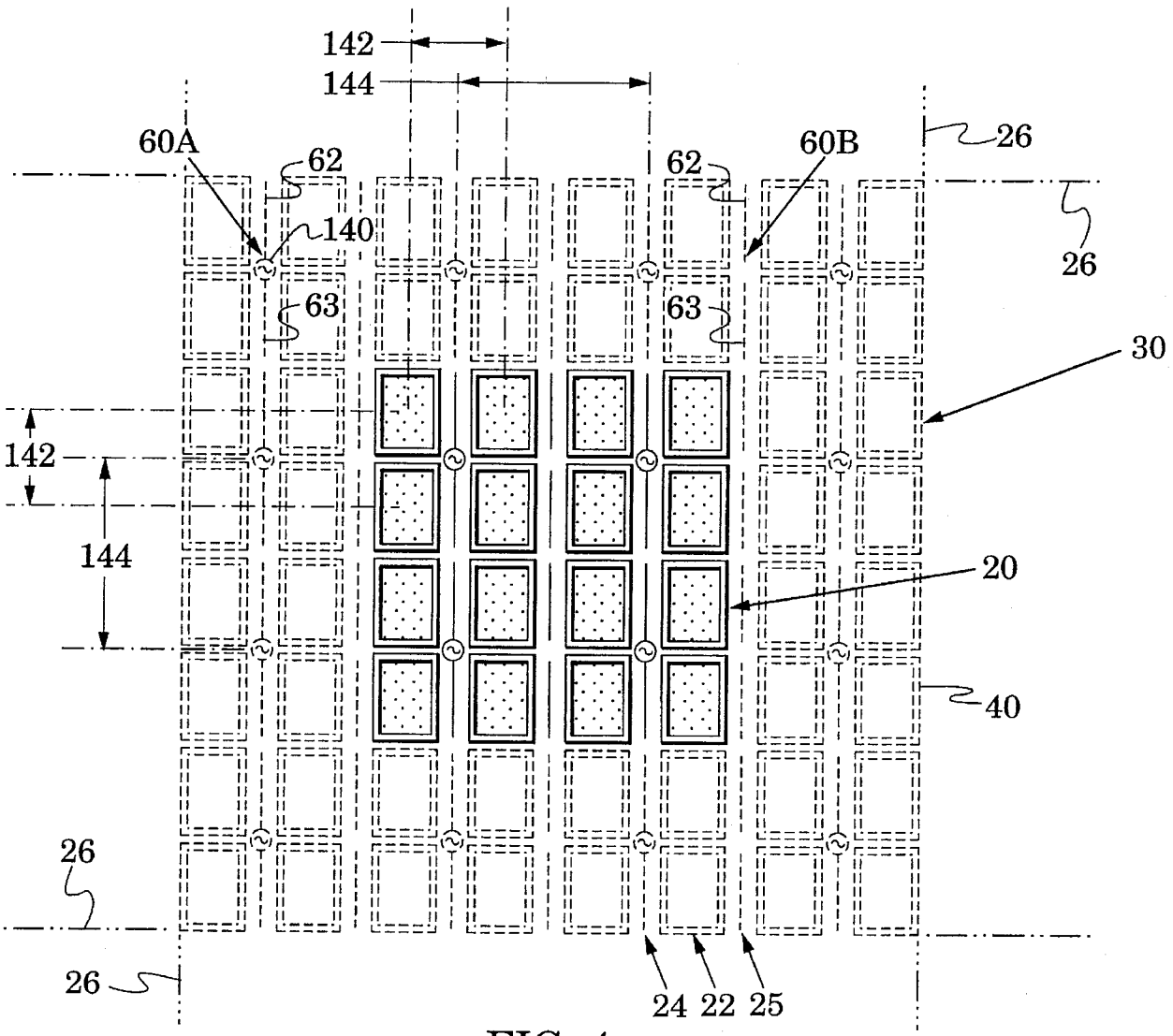
FIG. 4 is a schematized view of the aperture portion of FIG. 1.

A multiband, phased-array antenna in accordance with the present invention is illustrated in FIGS. 1, 2, 3A, 4–6, 7A and 7B. In particular, FIGS. 1 and 4 show an aperture portion 20 of the antenna, FIGS. 2 and 3A show a waveguide radiator 40 and a tapered-element radiator 60 that comprise the aperture portion 20 and FIGS. 5–6, 7A and 7B show a waveguide radiator feed network 80 and tapered-element radiator feed networks 100 and 120 which can distribute microwave signals to the radiators 40 and 60 of the aperture 20. FIG. 3B illustrates another embodiment of the tapered-element radiator of FIG. 3A.

The antenna aperture 20 can radiate three independent microwave antenna beams in response to three independent microwave signals which are received through the feed networks 80 and 100. Signals in first and second microwave frequency bands are received through the feed networks of FIGS. 6 or 7A and 7B and radiated by the tapered-element radiators 60A. Signals in a third microwave frequency band are received through the feed network 80 of FIG. 5 and radiated by the waveguide radiators 40. The three microwave signals can span more than two octaves of microwave frequency. For example, the first, second and third frequency bands can be S band, C band and X band.

Attention is first directed to the aperture portion 20 and its components as illustrated in FIGS. 1, 2, 3A and 4. The aperture portion 20 is formed with the waveguide radiators 40 and the tapered-element radiators 60 arranged in an interleaved relationship. In the embodiment 20, the tapered-element radiators are separated into radiators 60A and radiators 60B. The radiators 60A and 60B are structurally identical; the reason for the different reference numbers will become apparent as the embodiments of the invention are described in detail.

In particular, the aperture portion 20 includes waveguide radiator columns 22 which are formed with four waveguide radiators 40, tapered-element radiator columns 24 which are each formed with two of the tapered-element radiators 60A and a tapered-element radiator column 25 which is formed with two of the tapered-element radiators 60B. The waveguide radiator columns 22 are interleaved with the tapered-element radiator columns 24 and 25 with the tapered-element radiator column 25 positioned between the pair of tapered-element radiator columns 24.

Although an effective antenna aperture can be formed with just the aperture portion 20, its radiated microwave beams would be quite broad because the radiation beamwidth along a selected aperture plane of an array antenna is inversely proportional to the number of radiating elements along that plane. That is, narrower beamwidths are achieved with larger antenna apertures. Apertures of any desired size can be formed from the teachings of the present invention by extending the structure of the aperture portion 20 as is indicated by the broken extension lines 26, i.e., the height of the radiator columns 22, 24 and 25 can be extended in the elevation direction 28 and additional columns added in the azimuth direction 29.

This extension of the aperture portion 20 is further illustrated in the schematic of FIG. 4. The aperture portion 20 is shown there in full lines. The aperture pattern of the portion 20 is extended with similar radiators that are indicated by broken lines to form a larger aperture 30. The aperture 30 can be further extended as indicated by the broken extension lines 26.

A more detailed description of the structure and function of the aperture portion 20 is enhanced if it is preceded by a detailed description of the radiator elements of FIGS. 2, 3A and 3B and the feed networks of FIGS. 5, 6, 7A and 7B.

Accordingly, attention is now directed to the radiators 40 and 60. The waveguide radiator 40 has a waveguide section 42 with an input end 43 and a launch end 44. The input end 43 is adapted to receive microwave signals. This adaptation is realized with a coaxial connector 45 which is carried on the end 43. The connector 45 has a threaded end 46 for coupling to the feed networks of FIG. 5. The center conductor 47 of the jack 46 extends into the waveguide's input end 43 so as to launch an electromagnetic mode, e.g., the TE10 mode, in the waveguide cavity 48. Although the center conductor 47 is shown to define a loop 50 which is particularly useful for coupling to a magnetic field in the waveguide cavity 48, in other radiator embodiments it may define an electric probe which is particularly useful for coupling to an electric field in the waveguide interior.

The dimensions of the waveguide cavity 48 can be reduced by filling the cavity with a dielectric core 52 which has a relative permittivity $\epsilon_r$. If a specific microwave radiation has a free-space, guided wavelength $\lambda_g$, then it has an effective guide wavelength $\lambda_{ge}=\lambda_g(\epsilon_r)^{-1/2}$ if it is filled with the core 52. The benefit of this wavelength reduction will be apparent when attention is returned to the aperture 20. To reduce reflections in the waveguide 42, the cavity end 54 of the dielectric core 52 can be shaped to closely receive the loop 50.

As shown in FIG. 3A, the tapered-element radiator 60 has an input port 61, a pair of tapered wings 62 and 63 and a transmission line 64 which couples the input port 61 and the tapered wings 62 and 63. The radiator can easily be fabricated by coating each side of a substrate in the form of a thin dielectric sheet 65 with a conductive material, e.g., copper. The input port 61 is adapted for coupling to the feed networks of FIGS. 6, 7A and 7B. This adaptation is in the form of a coaxial mounting block 67 whose outer conductor or shell 68 is connected to one of the wings 62, 63 and whose inner conductor 69 is connected to the other of the wings.

The transmission line 64 is formed by a pair of coplanar conductive members 70 and 71 which each have a selectable and variable width 72 are which are separated by a slot 73, i.e., the transmission line 64 is a microstrip slot line. The impedance of the transmission line 64 is controlled by several parameters which include the thickness and permittivity of the dielectric sheet 65, the conductive member widths 72 and the spacing of the slot 73.

The conductors 70 and 71 are relatively narrow to reduce their capacitance while the tapered wings 62 and 63 are relatively wide to carry surface currents that will support a wide frequency bandwidth. In the region of the tapered wings 62 and 63, the slot 73 progressively widens as it approaches a radiation end 74 of the wings. This enhances the impedance match with free space over a wide radiation bandwidth. The radiation impedance is then transformed by the transmission line 64 to match the input port impedance.

In simple embodiments, the transmission line can be a quarter-wave impedance transformer. In more complex embodiments, it can essentially include multiple transformer sections. For example, the conductive member widths 72 can be varied in accordance with a Chebyshev taper to match the coaxial mounting block impedance, e.g., 50Ω, with the radiation impedance of the tapered wings 62 and 63. Because of the distinctive shape of the tapered wings 62 and 63 and the transmission line 64, the tapered-element radiator 60 is commonly referred to as a "bunny-ear" radiating element.

The radiator 60 is one embodiment of a class of radiators generally referred to as tapered-element radiators. Although the radiator 60 is especially suited for radiating a wide bandwidth of microwave frequencies, other tapered-element radiators can also be used to practice the teachings of the invention. For example, FIG. 3B illustrates another tapered-element radiator 75.

The tapered-element radiator 75 is similar to the radiator 60 of FIG. 3A with like elements having like reference numbers. The radiator 75 has a pair of conductive members 76 and 77 which are spaced to define a slot line 78 and which then flare outward from each other in a horn section 79 to effectively match the free-space impedance over a wide bandwidth. As opposed to the tapered-element radiator 60, the width of the conductive members 76 and 77 is not reduced between the input port 61 and the horn section 79. Thus, the radiator 75 typically exhibits a larger capacitance than the radiator 60 and although it can radiate over a wide bandwidth, it typically cannot match the exceptional bandwidth of the radiator 60.

Because of its distinctive appearance, the tapered-element radiator 75 is commonly referred to as a "flared notch" radiating element and also as a "Vivaldi horn" radiating element. The radiators 60 and 75 have been described in detail in various references, e.g., Lee, J. J. and Livington, S. I., "Wideband Bunny-Ear Radiating Element", IEEE AP-S International Symposium, Ann Arbor, Mich., 1993, pp. 1604–1607.

Figure 5:
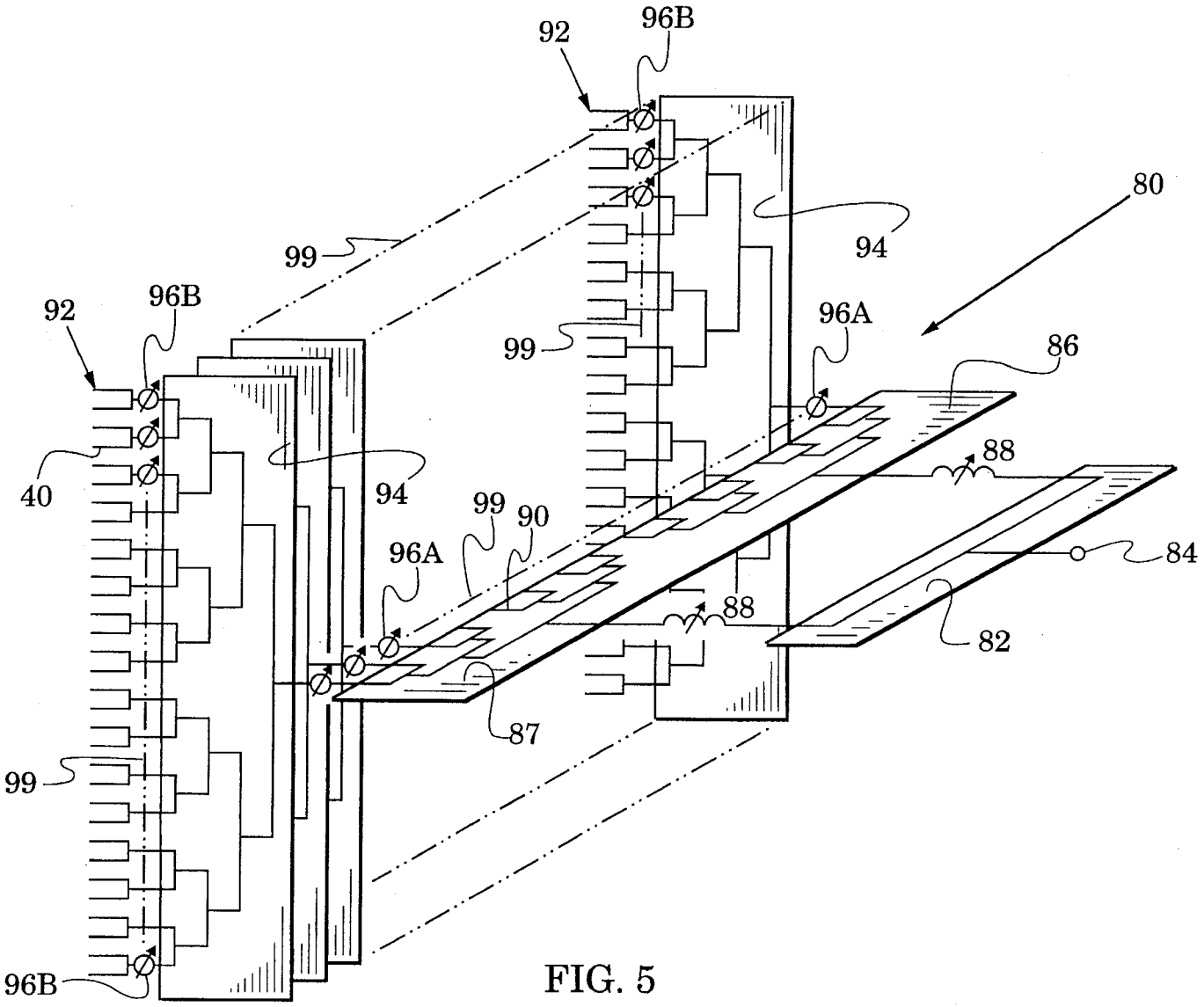
FIG. 5 is a schematic of a feed network for the distribution of microwave signals to waveguide radiators in the aperture of FIG. 1.

A feed network 80, for distributing microwave signals to the waveguide radiators 22 of FIG. 1, is illustrated schematically in FIG. 5. For illustrative purposes, the feed network 80 is configured to distribute microwave energy to a 16×16 lattice of waveguide radiators 40, i.e., a lattice in which the 4×4 lattice of FIG. 1 is extended, as indicated by the broken lines 26 of FIG. 1, to a 16×16 lattice. The network 80 has a power divider 82 which is connected to an input port 84, e.g., a coaxial connector. Each output of the power divider 82 is coupled to an 8-way power divider 86 by a pair of adjustable time delays 88. The 8-way power dividers 86 are carried on the same substrate 87. The power dividers 82 and 86 are positioned in the azimuth plane. Each output 90 of the power dividers 86 is coupled to a different column 92 of waveguide radiators 40 by a 16-way elevation power divider 94. Thus, microwave signals that enter the input port 84 are distributed to 64 waveguide radiators 40.

The feed network 80 also includes a plurality of phase shifters 96 for controlling the phase of microwave energy that is radiated from each of the waveguide radiators 40. The position of the phase shifters 96 is dependent upon the intended steering of the microwave beam that is radiated from the antenna aperture. For example, the radiation phase of each waveguide radiator column 92 must be separately controlled if the beam from the waveguide radiators 40 is to be scanned in the azimuth plane. To achieve azimuth scanning, a phase shifter must couple each output 90 of the azimuth power dividers 86 with a different one of the elevation power dividers 94. These phase shifter positions are indicated by the reference numbers 96A.

In contrast, the radiation phase of each microwave radiator 40 must be separately controlled if the beam from the radiators is to be scanned in two dimensions, i.e., in elevation and azimuth. To achieve two-dimensional scanning, a phase shifter must couple each of the waveguide radiators 40 to the elevation power dividers 94. These phase shifter positions are indicated by the reference numbers 96B. For clarity of illustration, only exemplary phase shifters 96 and elevation power dividers 94 are shown; the remaining phase shifters and power dividers are indicated by broken extension lines 99.

In operation of the feed network 80, microwave signals in the third microwave frequency band are inserted at the input port 84. The power of these signals is divided by 16 in the azimuth power dividers 86 and distributed to the elevation power dividers 94. The signal power to each divider 94 is again divided by 16 and distributed to each waveguide radiator 40.

If the feed network is configured with the phase shifters 96A, the radiated beam from the waveguide radiators 40 is scanned in the azimuth plane by selected phase changes in the phase shifters 96A. In contrast, if the feed network is configured with the phase shifters 96B the radiated beam from the waveguide radiators 40 is scanned in both the elevation and azimuth planes by selected phase changes in the phase shifters 96B.

Figure 6:
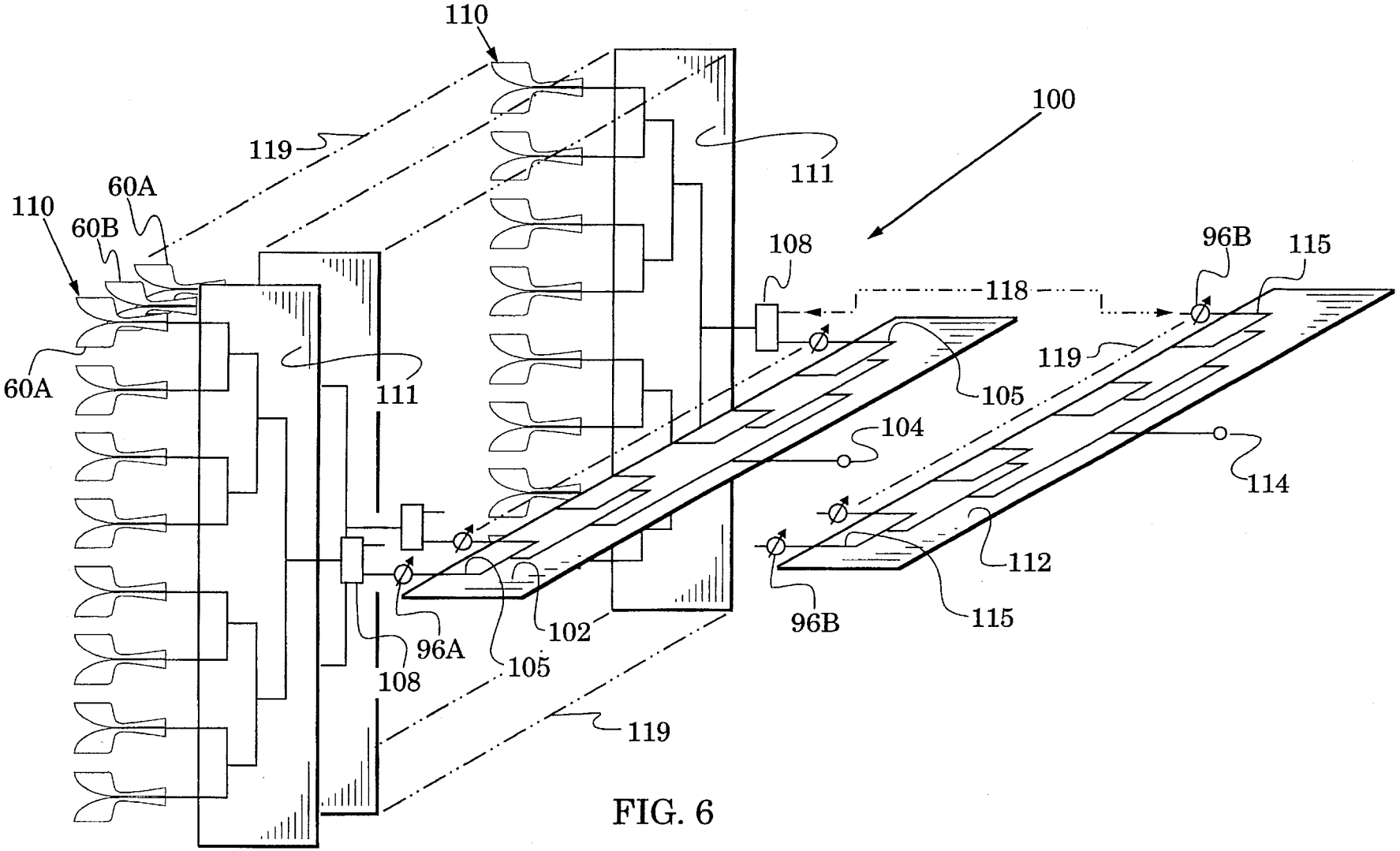
FIG. 6 is a schematic of a feed network for the distribution of microwave signals to tapered-element radiators in the aperture of FIG. 1.

A feed network 100 for distributing microwave signals to the tapered-element radiators 60A of FIG. 1 is illustrated schematically in FIG. 6. The feed network 100 is configured to distribute microwave energy to an 8×8 lattice of tapered-element radiators 60A, i.e., a lattice in which the 2×2 lattice of FIG. 1 is extended, as indicated by the broken lines 26 of FIG. 1, to an 8×8 lattice. The feed network is not coupled to dummy tapered-element radiators 60B which are interleaved with the tapered-element radiators 60A.

A variety of conventional phase shifters, e.g., ferrite phase shifters and diode phase shifters, may be used in the feed networks of the invention. Because the phase of different frequencies is different across a specific distance, phase shifters may cause the direction of a radiated beam to vary across a wide radiated frequency band. Accordingly, the phase shifters of FIG. 5 are augmented by variable time delays, e.g., delay lines. The phase induced by a time delay is inversely proportional to the frequency that transits the time delay. This effect can be used to reduce the variation in beam direction across wide radiated bandwidths.

The network 100 has an 8-way power divider 102 which is connected to an input port 104, e.g., a coaxial connector. The power divider 102 is positioned in the azimuth plane. Each output 105 of the power divider 102 is coupled to one input leg of a microwave diplexer 108 by a phase shifter 96A. The output of each diplexer 108 is coupled to a different column 110 of tapered-element radiators 60A with an 8-way elevation power divider 111.

The network 100 also includes an 8-way power divider 112 which is connected to an input port 114, e.g., a coaxial connector. The power divider 112 is positioned in the azimuth plane. Each output 115 of the power divider 112 is coupled to another input leg of the microwave diplexers 108 by a phase shifter 96B. For clarity of illustration, the connection between one of the phase shifters 96B and its respective diplexer 108 is indicated by a broken line 118. The other phase shifters 96B are similarly connected to their respective diplexers 108. Only exemplary phase shifters 96, radiator columns 110 and elevation power dividers 111 are shown; the remaining phase shifters, radiator columns and power dividers are indicated by broken extension lines 119.

The input port 104 and power divider 102 are configured and dimensioned to distribute microwave energy in a first microwave frequency band, e.g., S band, to the diplexers 108. The input port 114 and power divider 112 are configured and dimensioned to distribute microwave energy in a second microwave frequency band, e.g., C band, to the diplexers 108.

With the feed network 100, the phase of S band radiation from each tapered-element radiator column 110 can be separately controlled with the phase shifters 96A to achieve S band scanning in the azimuth plane. Simultaneously, the phase of C band radiation from each tapered-element radiator column 110 can be separately controlled with the phase shifters 96B to achieve C band scanning in the azimuth plane.

In operation of the feed network 100, microwave signals in the first and second microwave frequency bands are respectively inserted at the input ports 104 and 114. The power of these signals is divided by 8 in their respective azimuth power dividers 102 and 112 and distributed through their respective phase shifters 96A and 96B to the diplexers 108. In the diplexers, the signals of the first and second microwave frequency bands are combined and coupled to the tapered-element radiators 60A by the elevation power dividers 111. The S band radiated beam from the tapered-element radiators 60A is scanned in the azimuth plane by selected phase changes in the phase shifters 96A and the C band radiated beam from the tapered-element radiators 60A is scanned in the azimuth plane by selected phase changes in the phase shifters 96B.

As recited before, two-dimensional scanning is achieved by coupling each radiator to its feed network with a separate phase shifter. Accordingly, an alternate feed network for distributing microwave signals in the first and second frequency bands is illustrated schematically in FIGS. 7A and 7B.

Figure 7A:
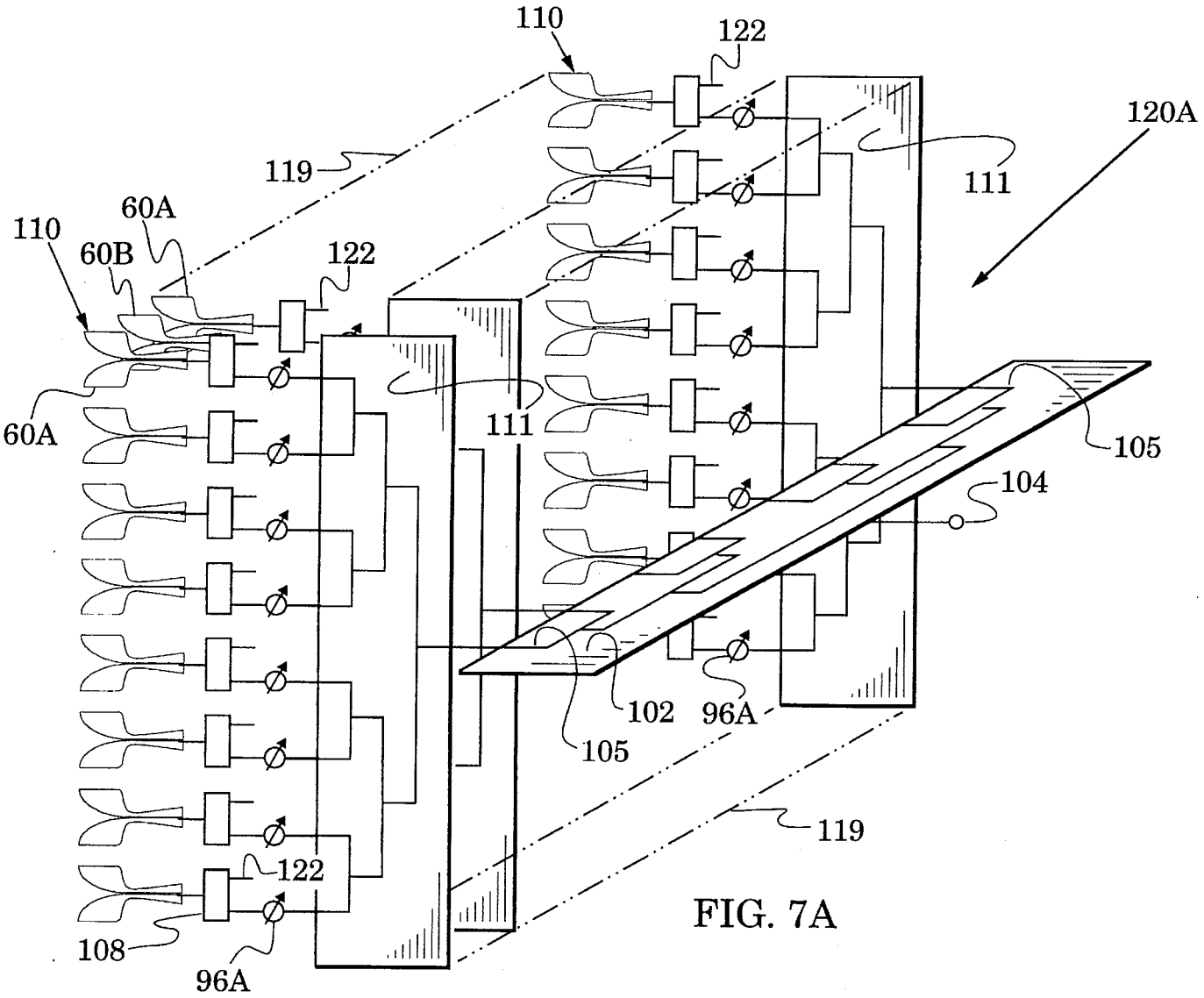
FIG. 7A is a first portion schematic of another feed network for the distribution of microwave signals to tapered-element radiators in the aperture of FIG. 1.
Figure 7B:
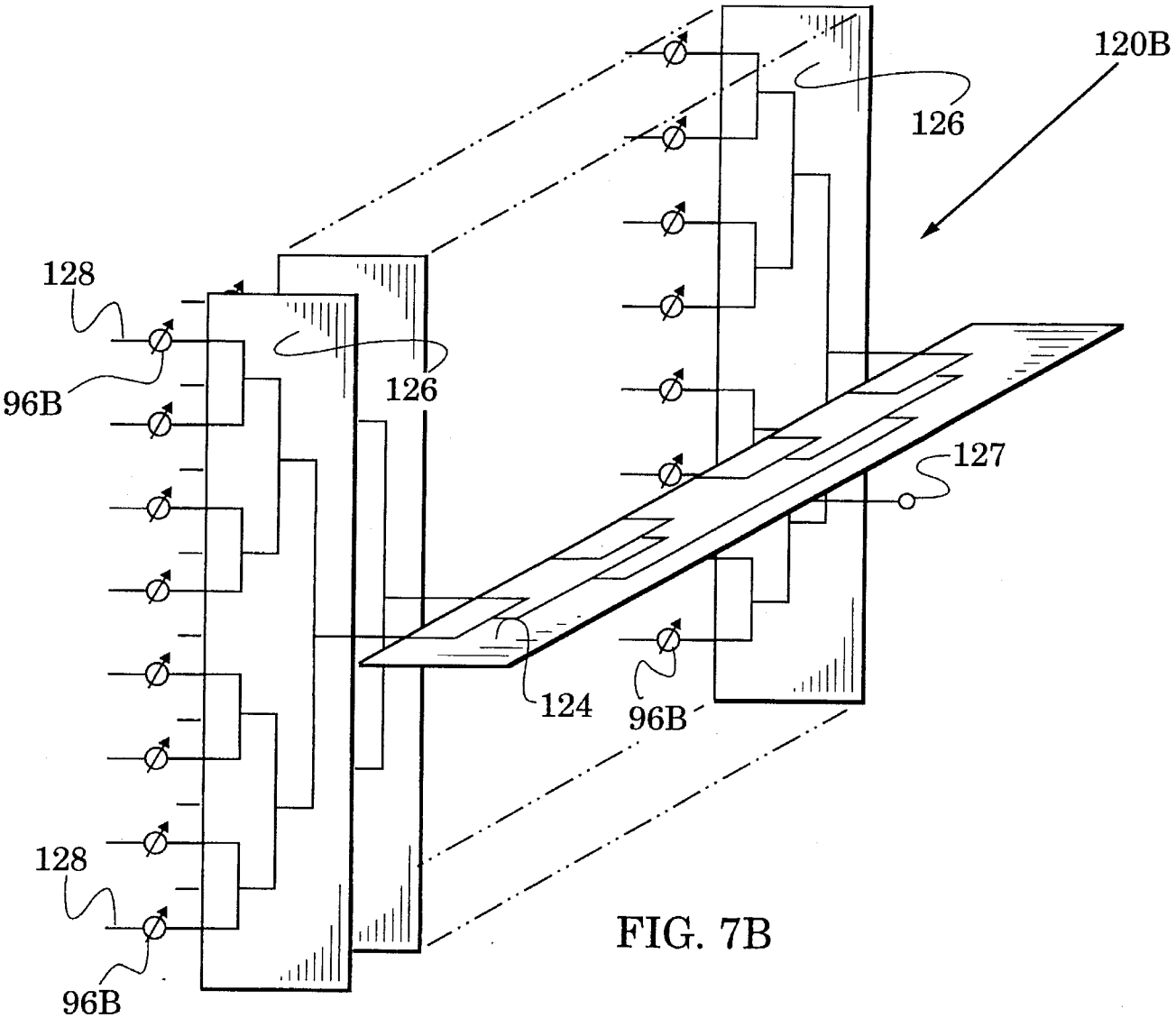
FIG. 7B is a second portion schematic of another feed network for the distribution of microwave signals to tapered-element radiators in the aperture of FIG. 1.

In particular, FIG. 7A shows a feed network portion 120A and FIG. 7B shows a feed network portion 120B. The feed network 120A is similar to the network 100 of FIG. 6 with like elements indicated by like reference numbers. In contrast with the feed network 100, the outputs 105 of the power divider 102 are coupled directly to the elevation dividers 111. Also, the tapered-element radiators 60A are coupled to the dividers 111 with phase shifters 96A and diplexers 108. The phase shifters 96A are each connected to one leg of a different one of the diplexers 108. The other diplexer leg 122 is available for connection to the feed network portion 120 B.

The feed network 120B is similar to the portion of the feed network 120A that includes the power dividers 102 and 111 and phase shifters 96A. In the feed network 120B, the azimuth power divider is referenced as 124, the elevation power dividers are referenced as 126 and the phase shifters are referenced as 96B. The divider 124 has an input port 127 and the phase shifters 96B each have an output port 128. The feed networks 120A and 120B can be combined into one composite feed network by connecting each phase shifter port 128 of FIG. 120B with a respective diplexer leg 122 in FIG. 120A.

The operation of such a composite feed network is similar to the operation of the feed network 100 of FIG. 6. In contrast with the feed network 100, the distributed microwave signals are combined in diplexers 108 which are dedicated to each tapered-element radiator 60A. The S band radiated beam from the tapered-element radiators 60A is then scanned in both elevation and azimuth planes by selected phase changes in the phase shifters 96A of FIG. 7A and the C band radiated beam from the tapered-element radiators 60A is scanned in the elevation and azimuth planes by selected phase changes in the phase shifters 96B of FIG. 7B.

In FIGS. 5, 6, 7A and 7B, the power dividers 82, 86, 94, 102, 111, 112, 124 and 126 are realized with transmission lines that are separated from a ground plane by a dielectric substrate, i.e., a microstrip structure. In general, they can be realized with any conventional microwave transmission structure, e.g., stripline. The feed networks 100, 120A and 120B can also be augmented with variable time delays, e.g., the time delays 88 of FIG. 5.

With a detailed description of the radiator elements 40 and 60 and the feed networks 80, 100, 120A and 120B in hand, attention is now redirected to the aperture portion 20 of FIGS. 1 and 4. With reference to FIGS. 6, 7A and 7B, it was mentioned above that the tapered-element radiators 60A are coupled to the feed networks, e.g., the network 100 of FIG. 6, and that the tapered-element radiators 60B are not. This coupling and lack of coupling is schematically indicated in FIG. 4 by indicating each tapered-element radiator 60A as a pair of wings 62 and 63 which are connected by a microwave generator 140 and by indicating each tapered-element radiator 60B as having only a pair of wings 62 and 63, i.e., the radiators 60B are not coupled to an energy source.

In FIG. 4, the waveguide radiators 40 are shown to be spaced in elevation and azimuth by a span 142 and the tapered-element radiators 60A are spaced in elevation and azimuth by a span 144. It has been shown by various authors (e.g., Skolnik, Merrill I., Radar Handbook, McGraw-Hill, Inc., New York, second edition, pp. 7–10 to 7–17) that only a single radiated beam will be formed if the span between radiators is less than $\lambda/2$ for the highest radiated frequency, i.e., no grating lobes will be generated. Grating lobes are generally to be avoided because when they are generated in the scan area of interest, target returns cannot be analyzed to find the target direction, i.e., it is not known which radiation lobe caused a given return. As discussed in Skolnik, the span can be increased to $<0.53\lambda$ and to $<0.58\lambda$ if the scanning of the antenna is limited to +/–60° and +/–45°.

Therefore, the span 144 between the tapered-element radiators 60A is preferably less than $\lambda/2$ for the highest frequency of the first and second microwave frequency bands that is inserted into the feed networks 100, 120A and 120B of FIGS. 6, 7A and 7B. Similarly, the span 142 between the waveguide radiators 40 is preferably less than $\lambda/2$ for the highest frequency of the third microwave frequency band that is inserted into the feed network 80 of FIG. 5.

For example, if the third microwave frequency band covers the range of 8 to 10 GHz, the highest expected frequency of the signals inserted into the input port 84 in FIG. 5 is 10 GHz which has a wavelength $\lambda$ of 3 centimeters. Therefore, the span 142 is preferably set to approximately 1.5 centimeters or less. Because of the interleaved arrangement of radiators in the aperture 20, the span 144 is twice the span 142. In this example, the span 144 is 3 centimeters which is $\lambda/2$ for radiation of 5 GHz. Thus, the subarray of tapered-element radiators 60A will not produce grating lobes for frequencies less than 5 GHz and the subarray of waveguide radiators 40 will not produce grating lobes for radiated frequencies less than 10 GHz.

These spans which do not produce undesired grating lobes are strictly true when the subarrays are not in the presence of other radiators. Because of coupling effects, other radiators that are near the waveguide radiators 40 should also have a span between them of λ/2 at 10 GHz. This is accomplished in the aperture portion 20 by the insertion of the columns 25 of dummy tapered-element radiators 60B. These radiators need not be energized; their presence insures that the waveguide radiators 40 will not produce grating lobes when the aperture 20 is scanned in azimuth which is a common requirement of naval shipboard radars.

In order to achieve a span 142 of 1.5 centimeters, the waveguide radiators 40 are preferably loaded with a dielectric which lowers their effective guide wavelength $\lambda_{ge}$. For example, if the permittivity of the core 52 in FIG. 2 is 1.6, the vertical and horizontal dimensions of the waveguide section 42 can be respectively set at substantially 1.4 and 1.0 centimeters which is compatible with the span 142.

The spans 144 are far less than required to avoid grating lobes for the S band radiation from the tapered-element radiators 60A. Therefore, the feed structures of FIGS. 6, 7A and 7B may be modified if desired to employ "block feeding" in the first microwave frequency band. That is, in the lowest frequency band all four of the tapered-element radiators 60A of the aperture portion 20 could be energized with signals having the same phase. In this band, the span between radiating elements is then essentially twice the span 144 or 6 centimeters. This span would be less than λ/2 for radiation below 2.5 GHz.

Figure 8:
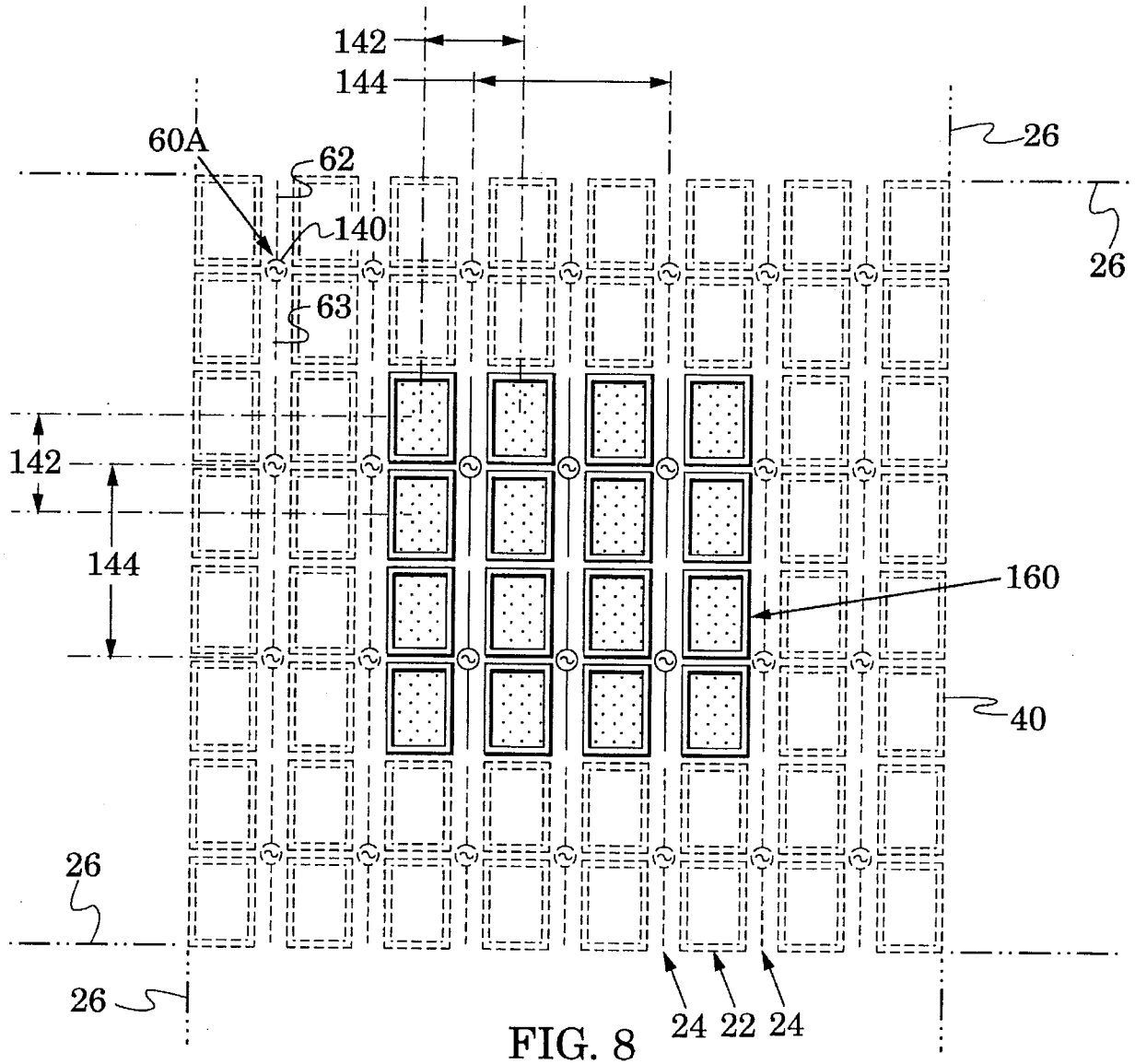
FIG. 8 is a schematized view of another aperture portion embodiment.

Although the columns 25 of dummy tapered-element radiators 60B need not be radiated to insure that the waveguide radiators 40 do not produce azimuth grating lobes, they may be energized to increase the power and uniformity of their radiated beams. This arrangement is shown in the interleaved aperture portion embodiment 160 of FIG. 8. The aperture portion 160 is similar to the aperture portion 20 with like elements indicated by like reference numbers. However, in the aperture portion 160 columns 22 of waveguide radiators 40 are interleaved only with columns 24 of energized tapered-element radiators 60A.

Figure 9:
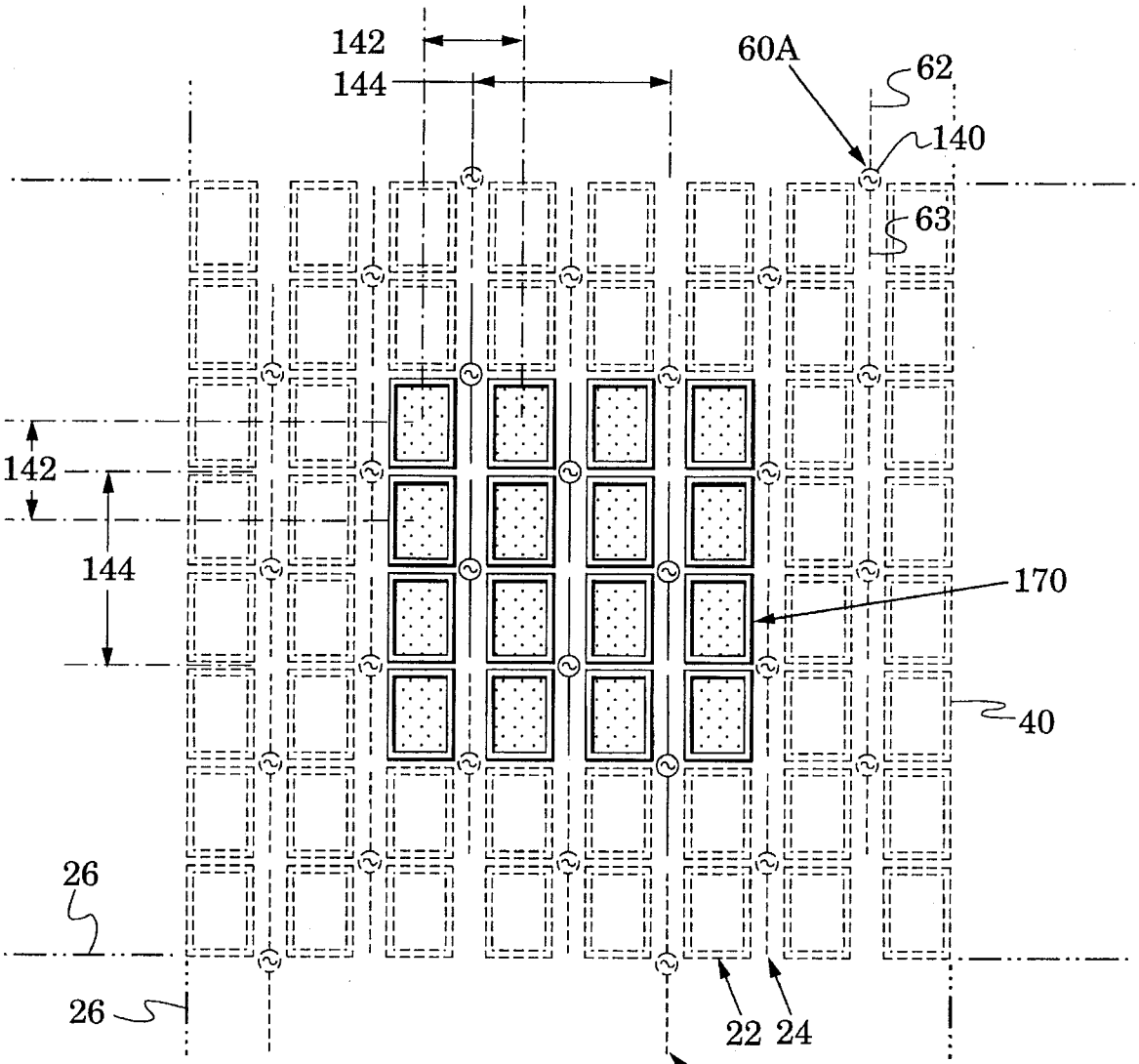
FIG. 9 is a schematized view of another aperture portion embodiment.

In the aperture portion 160, the tapered-element radiators 60A form a rectangular lattice, i.e., they are arranged in vertical columns and horizontal rows. It has been shown (e.g., Skolnik, Merrill I., Radar Handbook, McGraw-Hill, Inc., New York, second edition, pp. 7–17 to 7–21) that an arrangement of radiators in a triangular lattice will produce lower grating lobes than a rectangular lattice of equal column spacing. Alternatively, for the same intensity of grating lobes, the column spacing in a triangular lattice can be increased. In other words, a triangular lattice arrangement can reduce the number of radiators that is required to achieve a specific grating lobe reduction. A triangular lattice is achieved in the aperture portion embodiment 170 of FIG. 9. In this aperture portion, alternate columns 24 have been vertically offset by the span 142 so that the tapered-element radiators 60A define a triangular lattice.

Although the aperture embodiments described to this point have been directed to radiation in dual bands from the tapered-element radiators 60A and radiation in a single band from the waveguide radiators 40, the teachings of the invention can be extended to other multiband radiation configurations. For example, in FIG. 8 the waveguide radiators 40 can be dimensioned and spaced for radiation in X and Ku band and the tapered-element radiators 60A dimensioned and spaced for radiation in S and C band. Various interleaving patterns of the tapered-element radiators and waveguide radiators can be devised in accordance with the teachings of the invention to achieve spans between radiators which will avoid grating lobes in the scan area of interest.

In FIG. 1, the launch ends (44 in FIG. 2) of the waveguide radiators 40 are arranged to collectively define a ground plane. This ground plane is illustrated with the broken line 172 in FIG. 3A. The wide band radiation of the tapered-element radiators 60 is enhanced by proper adjustment of the distance between the radiation end 74 of the tapered wings 62 and 63 and this ground plane 172. That is, each of the tapered wings 62 and 63 preferably extends past the ground plane 172 by a distance 174 which is selected to establish a predetermined tapered wing radiation impedance. Although the launch ends 44 of the waveguide radiators is shown to define a planar ground plane in FIG. 1, other arrangement embodiments may define various ground plane shapes, e.g., one conforming to an airplane surface.

The tapered-element radiator 60 shown in FIG. 3A was modeled on a computer with the dimensions 174 and 176 of FIG. 3A respectively set to 3.12 and 2.97 centimeters. The reflection coefficient of radiation impedance was calculated for an array of such radiators with various scan angles. The reflection coefficient was less than 0.4 (84% of radiation power transmitted) for scan angles up to 45° across a frequency range of substantially 2.2 to 5.1 GHz in a plane which is orthogonal to the plane of the tapered wings. The reflection coefficient was less than 0.4 (84% of radiation power transmitted) for scan angles up to 30° across a frequency range of substantially 2.7 to 5.0 GHz in a plane which is parallel with the plane of the tapered wings.

The cutoff frequency of the waveguide radiators 40 provides a natural filter to enhance the isolation of the waveguide subarray from the tapered-element subarray. Similarly, the response of the tapered-element radiators falls off at the higher frequency of the waveguide radiators which enhances the isolation of the tapered-element subarray. In addition, the diplexers 108 of FIGS. 6 and 7A inherently provide isolation filtering. If desired, additional filters can be installed in the feed networks of FIGS. 6, 7A and 7B to further isolate the tapered-element radiator subarray from the waveguide radiator subarray.

The embodiments of the invention have been illustrated with columns of radiators, e.g., the columns 22, 24 and 25 in FIG. 1. It should be understood that this is for illustrative purposes and that columns is used as a generic term which indicates any linear arrangement regardless of its spatial angle. In addition the orientation of the radiators need not be limited to vertical and horizontal arrangements, e.g., the aperture portion 20 in FIG. 4 could be rotated by any desired angle.

The electric field of the tapered-element radiators is inherently oriented between the tapered wings (62 and 63 in FIG. 3A). Although embodiments of the invention can have the waveguide radiators energized with their electric field oriented orthogonally with the electric field of the tapered-element radiators, this is not a requirement of the invention and other electric field orientations can be effectively employed.

As is well known, antennas have the property of reciprocity, i.e., the characteristics of a given antenna are the same whether it is transmitting or receiving. The use of terms such as radiators, feed network and distribution in the description and claims are for convenience and clarity of illustration and are not intended to limit structures taught by the invention. An antenna which can generate multiband radiation inherently can receive the same multiband radiation.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A multiband, phased array antenna, comprising:

a first subarray of tapered-element radiators, each of said tapered-element radiators having a pair of tapered wings which are dimensioned to radiate energy in a lower microwave frequency band and in a middle microwave frequency band;

a second subarray of waveguide radiators, each of said waveguide radiators having a launch end and dimensioned to radiate energy from said launch end in an upper microwave frequency band;

said first subarray and said second subarray arranged in an interleaved relationship with the tapered wings of said tapered-element radiators extending past the launch ends of said waveguide radiators by a distance which establishes a predetermined tapered wing radiation impedance;

a first microwave feed network configured to receive microwave signals in said lower microwave frequency band and in said middle microwave frequency band and to distribute them to said tapered-element radiators;

a plurality of lower microwave frequency band phase shifters positioned in said first microwave feed network to selectively phase shift said microwave signals in said lower microwave frequency band;

a plurality of middle microwave frequency band phase shifters positioned in said first microwave feed network to selectively phase shift said microwave signals in said middle microwave frequency band;

a plurality of diplexers positioned in said first microwave feed network to couple said lower microwave frequency band phase shifters and said middle microwave frequency band phase shifters with said tapered-element radiators;

a second microwave feed network configured to receive microwave signals in said upper microwave frequency band and to distribute them to said waveguide radiators; and a plurality of upper microwave frequency band phase shifters positioned in said second microwave feed network to selectively phase shift said microwave signals in said upper microwave frequency band.

2. The multiband, phased array antenna of claim 1, wherein each of said tapered-element radiators includes a microstrip slot line coupling it to one of said diplexers.

3. The multiband, phased array antenna of claim 1, wherein said tapered wings are configured with a Chebyshev taper.

4. The multiband, phased array antenna of claim 1, wherein each of said tapered-element radiators is a bunny-ear radiator.

5. The multiband, phased array antenna of claim 1, wherein each of said tapered-element radiators is a flared-notch radiator.

6. The multiband, phased array antenna of claim 1, wherein said waveguide radiators each have an input end adapted to receive said microwave signals in said upper microwave frequency band from said second microwave feed network.

7. The multiband, phased array antenna of claim 6, wherein each of said waveguide radiators has an interior which communicates with its launch end and further has a dielectric core positioned in said interior.

8. The multiband, phased array antenna of claim 1, wherein:

said first subarray is arranged in a rectangular lattice; and said second subarray is arranged in a rectangular lattice.

9. The multiband, phased array antenna of claim 1, wherein:

said first subarray is arranged in a triangular lattice; and said second subarray is arranged in a rectangular lattice.

10. The multiband, phased array antenna of claim 1, further including a plurality of dummy tapered-element radiators interleaved with said first subarray.

11. The multiband, phased array antenna of claim 1, wherein said lower microwave frequency band is S band, said middle microwave frequency band is C band and said upper microwave frequency band is X band.

12. The multiband, phased array antenna of claim 1, wherein said lower microwave frequency band is S band, said middle microwave frequency band is C band and said upper microwave frequency band is Ku band.

* * * * *